United States Patent [19]

Nagata

[11] 4,185,261

[45] Jan. 22, 1980

[54] ELECTROMAGNETIC LIFTING DEVICE

[75] Inventor: Toshio Nagata, Tokyo, Japan

[73] Assignee: Kohan Sendan Kikai Kabushiki Kaisha, Japan

[21] Appl. No.: 928,596

[22] Filed: Jul. 27, 1978

[51] Int. Cl.[2] ..... H01F 7/06; B66C 1/06

[52] U.S. Cl. ..... 335/291; 294/65.5

[58] Field of Search ..... 335/291, 290, 289; 294/65.5

[56] References Cited

U.S. PATENT DOCUMENTS

| | | | |
|---|---|---|---|
| 675,323 | 5/1901 | Clark | 335/291 |
| 777,221 | 12/1904 | Piek | 335/291 |
| 1,232,532 | 7/1917 | Griffith | 335/289 |
| 1,316,672 | 9/1919 | Bethke | 335/291 |
| 3,298,730 | 1/1967 | Soley | 335/291 |

*Primary Examiner*—Harold Broome

*Attorney, Agent, or Firm*—Kane, Dalsimer, Kane, Sullivan and Kurucz

[57] ABSTRACT

An electromagnetic lifting device comprising a plurality of electromagnets having a variety of individual magnetic pole face areas and an inverted generally U- or W-shape connected with each other and further rigidly connected to a suspension member, and specifically adapted to electromagnetically lift up only a single sheet of ferromagnetic metal sheet by energizing a selected one or plurality of the electromagnets to an extent of necessary and enough electromagnetic energy in accordance with a thickness of the single sheet of metal and exerting thus-produced electromagnetic force to that single sheet of metal so that only that single sheet of metal can be lifted upwardly away from a pile of such metal sheets.

9 Claims, 6 Drawing Figures

ELECTROMAGNETIC LIFTING DEVICE

BACKGROUND OF THE INVENTION

The present invention relates in general to an electromagnetic lifting device, and more particularly to an electromagnetic lifting device specifically designed for lifting up a single sheet of ferromagnetic metal such as steel sheet.

In the case that it is required, by using an electromagnet, to pick up and lift a sheet of steel material, sheet by sheet, from a pile of such steel materials stored at a material stock yard as in a sheet steel processing factory, it is most adaptable and efficient in practice to apply an electromagnet having a magnetic pole face area in accordance with a thickness of such sheet material. However, for this purpose, it is eventually essential to have a plurality of electromagnetic elements producing an electromagnetic energy that correspond to each of thicknesses of such sheet material in stock, and this is so inconvenient and impracticable.

In order to avoid such inconventineces, it is generally a practice that an electromagnet is prepared which is adaptable to magnetically hold and lift up a sheet material having a possibly largest thickness in stock or having a relatively large area of electromagnetic pole face, and then this particular electromagnet is used to hold and lift up a sheet material having a relatively thin thickness by adjusting an energizing power at an optimal level for handling such relatively thin sheet steel.

Particularly in the case that a sheet material having such a relatively thin thickness as 9 mm or less is handled with the electromagnet having such relatively large area of magnetic pole face, however, the energizing power may be restricted to a lowest possible extent, there is exerted an electromagnetic force not only to an uppermost sheet in a pile of sheet material but also to a next one or more sheets, thus resulting in such an inconvenience that one or more sheets of steel material might as well be induced to draw to each other and lifted upwardly together. This is because an excessive magnetic force is exerted to the uppermost sheet material and the successive lower sheet material in a piled stock.

In such case, such steps are generally taken that two or more sheets material that happen to draw to each other are once lifted upwardly together under the effect of the electromagnet, then the energizing power is cut off once for a very short moment by flipping a current switch to off so that the desired only one sheet material may be left drawn and rest on the magnetic pole face of the electromagnet as it is by function of a residual magnetism working thereon and the unwanted extra one or more sheets of steel induced to be attracted to the required one sheet may fall out of engagement therewith by their own weights down to the ground, thereafter having the energizing current restored in the energizing coil by putting the switch back to "ON" position so as to maintain the attraction or magnetic force of the electromagnet on the desired one sheet.

However, it is apparent that such manual switching operation is an unreliable and dangerous task and would turn to be a substantial loss in the working time even with a proficient operator, and also, it is impossible to remotely conduct such delicate operation at the working site. Moreover, this manual operation should naturally be practiced under the immediate supervision of the operator, and therefore, such lifting services may not be made under an unmanned or automated condition. In addition, as in the case of handling the steel sheet having a relatively long extension wherein a plurality of electromagnet are used to operate at a time to lift up a sheet steel of a long dimension, it is very difficult to have only one sheet of lengthy steel sheet kept drawn and rest stably in position of the magnetic pole face with a single operation because of an occasional difference or unevenness in the states of magnetic holding effected by each of these electromagnets.

How advantageous it would be if there is made available an efficient means to overcome such problems as encountered in the prior art electromagnetic lifting devices. The present invention is essentially directed to meet such requirements.

SUMMARY OF THE INVENTION

It is therefore a primary object of the present invention to provide an improved electromagnetic lifting device which is adaptable to positively and safely hold and lift up an uppermost single sheet from a pile of sheets in stock.

It is another object of the invention to provide an improved electromagnetic lifting device which is adaptable to have a lifting operation substantially simplified in which only a single sheet is positively lifted upwardly at a time.

It is still another object of the invention to provide an improved electromagnetic lifting device which is adaptable to positively hold and lift up only a single sheet of steel even in the case that thickness of steel sheets piled up in a stacked state varies substantially from each other.

According to the present invention, briefly summarized by way of a preferred embodiment thereof, there is provided an improved electromagnetic lifting device which generally comprises a plurality of unit electromagnets having different areas of working or magnetic pole face, the plurality of unit electromagnets being connected with each other by means of a plurality of blocks or support members made of a nonferromagnetic material, and collectively housed in a suspended relationship from a member having a form of a casing of the electromagnetic lifting device.

In more detail, the electromagnetic lifting device according to this invention has a construction as comprising a plurality of electromagnetic pole or core members, each having a working or magnetic pole face located in a common horizontal plane, at least one current coil adapted to electromagnetically energize each of the magnetic core members, a plurality of blocks or members made of a nonferromagnetic material and disposed between the magnetic core members for operatively connecting the adjacent magnetic core members as a unit, and a suspension member also made of a non-ferromagnetic material for rigidly accommodating the plurality of electromagnetic core members in a collectively suspended fashion therefrom, the plurality of electromagnetic core members having different areas of working or magnetic pole faces being arranged in combination in such a manner that they become adjacent with each other and in a symmetrical relationship with respect to the center line of the suspension member.

According to one aspect of the present invention, it is possible in practice that only an uppermost single sheet of steel material can be attracted and lifted upwardly from a pile of such steel sheets by function of an electromagnetism generated by a selected one or more of the plurality of electromagnets in accordance with a thickness of the single sheet to be handled, such lifting-up operation being made available positively and sefely without any proficiency in operation, and furthermore, without any danger in operation or any substantial losses of time.

According to another aspect of the invention, there is provided an improvement wherein the magnetic pole face areas of the individual electromagnets or electromagnetic core members are selected in accordance with a variety of thickness of the steel sheets to be handled, so that a selective combination of one or more electromagnets having different working or magnetic pole face areas may work together to electromagnetically draw and lift up a single sheet of steel having a thickness corresponding to a sum of the number of such electromagnetic core members having different magnetic pole face areas and the number of combination or group of such electromagnetic core members. With such advantageous features of this invention, it can be said that the electromagnetic lifting device can now be designed with a further extensive range of adaptation to a variety of thicknesses of the steel sheets to be handled than in the conventional electromagnetic lifting device.

Further objects and advantageous features of the present invention will become more apparent when read the following detailed description by way of preferred embodiments thereof in conjunction with the accompanying drawing, in which like parts are designated with like reference numerals.

DETAILED DESCRIPTION OF THE INVENTION

Figure 1:
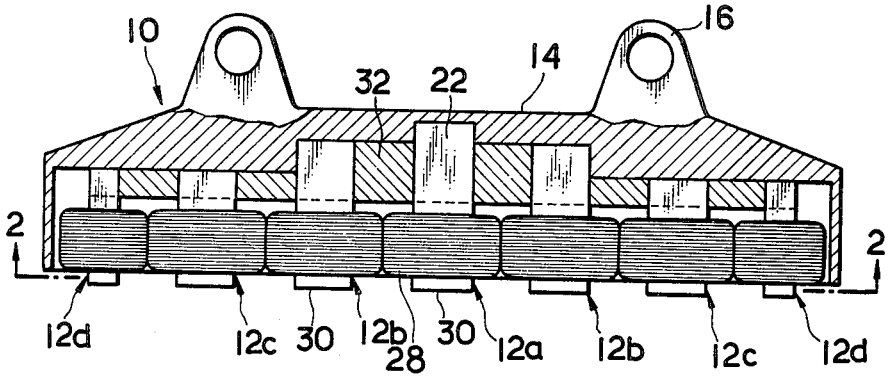
FIG. 1 is an elevational view, partly in cross-section, showing an electromagnetic lifting device according to the present invention.
Figure 2:
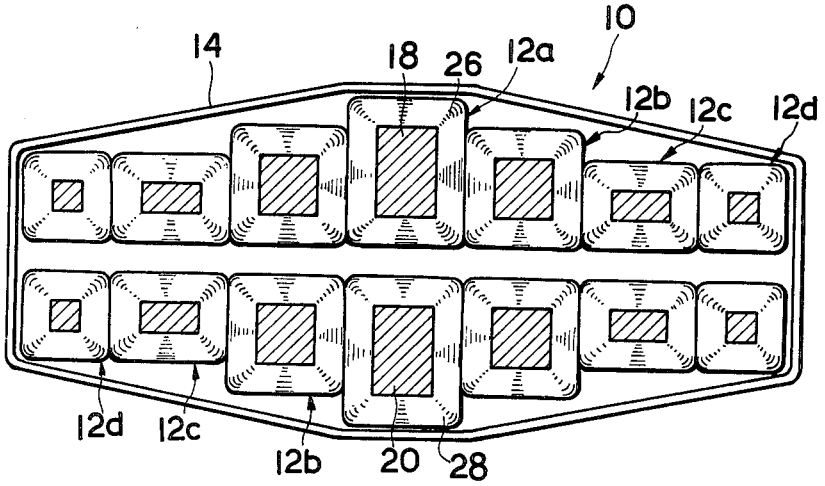
FIG. 2 is a transverse cross-sectional view taken along the plane as designated with the line 2—2 of FIG. 1, showing the working section of a magnetic pole or core members, each constituent to the entire electromagnetic lifting device.

Referring now to FIGS. 1 and 2, an electromagnetic lifting device 10 is shown, by way of a preferred embodiment of the invention, as comprising a plurality of electromagnets 12 (consisting of elements of 12*a* through 12*d*) having different core dimensions or pole face areas and connected with each other, and a casing or suspension member 14 for collectively accommodating the plurality of electromagnets 12 in a suspended fashion. The suspension member 14 is formed of a non-ferromagnetic material such as stainless steel, at the top of which there are disposed a pair of suspension links 16. In this pair of suspension links 16, there is to be connected a pair of hooks (not shown) provided at leading ends of a pair of wires extended from a crane or the like so as to be lifted upwardly in the air.

Figure 3:
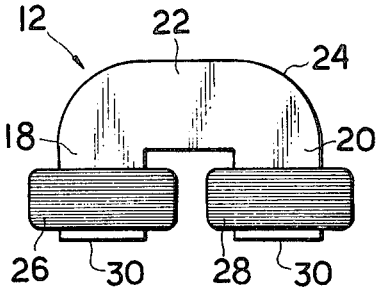
FIG. 3 is a side elevational view showing typically one of the plurality of electromagnets constituting the entire electromagnetic lifting device.

Each of the electromagnets 12 comprises, as best seen in FIG. 3, a magnetic pole or core member 24 of an inverted generally U-letter shape having a pair of leg portions extending outwardly in parallel 18,20, a web portion 22 connecting the pair of leg portions as a unit, and a pair of electrical coils 26,28 provided turning around the pair of leg portions. The pair of leg portions 18,20 of each electromagnet 12 is designed with an equal extension, and having a magnetic pole faces 30 at the outer free ends thereof. These magnetic pole faces 30 are arranged in a coplanar relationship with each other in each electromagnet, and the individual electromagnets or magnetic elements 12*a* through 12*d* are welded with their web portions 22 of the core member 24 immediately against the inside of the suspension member 14 so that the magnetic pole faces 30 may be aligned in a coplanar relationship with each other, as typically shown in FIG. 1.

The individual electromagnetic elements 12*a* through 12*d* are, as also shown in FIG. 1, connected to each other by means of a plurality of blocks or members 32 made of a non-ferromagnetic material such as stainless steel disposed and welded rigidly between the web portion 22 of the magnetic core member 24 located adjacent to each other.

Each of the coils 26,28 is connected to a power source through a current switch (not shown) arranged for each magnetic core member. Alternatively, the current switch may of course by provided between the power source for each of the current coils of the electromagnets 12.

As typically seen in FIG. 2, each of the individual electromagnets 12*a* through 12*d* differs in the core dimensions or pole face areas of the magnetic core member 24, among which the one 12*a* located in the middle or center of the array has a largest area of magnetic pole face 30, the outermost ones 12*d* at the right and left sides as seen in FIG. 2 having a smallest area of magnetic pole face.

In the illustrated construction, there are arranged the plurality of unit or individual electromagnets or elements 12*a* through 12*d* having different magnetic pole face areas side by side in an array such that the electromagnetic element 12*a* having the largest magnetic pole face area is disposed in the middle or center, and other electromagnetic elements 12*b* through 12*d* are arranged in such a symmetric relationship with respect to the center line of the lifting device 10, with their magnetic pole face areas getting smaller in graduation to the ones 12*d* having the smallest magnetic pole face area in the outermost locations of the lifting device, as generally viewed in FIG. 2. With such symmetrical arrangement of the constituent electromagnetic elements 12*a* through 12*d*, the entire electromagnetic lifting device 10 can be in a good balance when lifted upwardly into the air.

Figure 4:
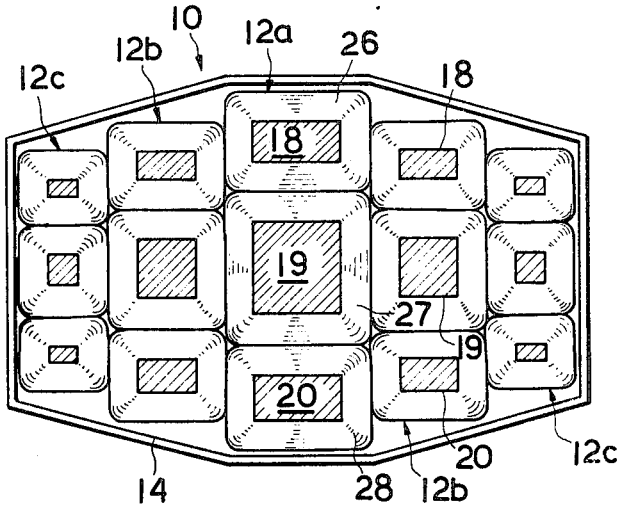
FIG. 4 is a similar view to FIG. 2 showing a second embodiment of the invention.
Figure 5:
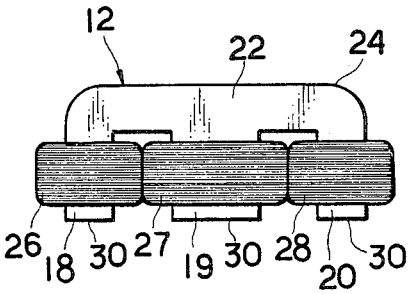
FIGS. 5 and 6 are also similar views to FIG. 3 showing other forms of embodiment of the invention, respectively.

In FIGS. 4 and 5, there is shown another embodiment of the electromagnetic lifting device 10 according to this invention, wherein each of the electromagnets 12 or individual electromagnetic elements 12*a* through 12*c* comprises a magnetic pole or core member 24 including three extensions or leg portions extending outwardly in parallel to each other 18, 19, 20 and a transverse web portion 22 connecting the three leg portions as a unit, and three coils 26,27,28 provided turning around the three leg portions 18,19,20 of the magnetic core member 24.

Figure 6:
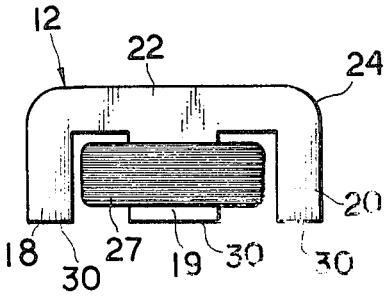

As an alternative construction as illustrated in FIG. 6, the electromagnet 12 may naturally comprise the magnetic core member 24 having an inverted generally W-letter shape and a coil 27 provided around the only central leg portion 19.

In general, the central leg portion 19 of each of the magnetic core member 24 may be designed with an area of magnetic pole face 30 twice as large as that of each leg portion 18,20 disposed on either outer side.

In more detail, the transverse cross-sectional area of the magnetic pole face 30 of each magnetic core member as shown with hatching in FIGS. 2 and 4 can be determined in accordance with a thickness of a sheet steel to be handled in the lifting operation. For instance, in the exemplary construction as shown in FIG. 2, the magnetic pole face area of the magnetic core member 24 of the electromagnet elements 12*a* disposed in the central position of the lifting device 10 is determined to obtain a magnetism and a depth to which magnetic lines of force can reach that will be sufficient enough to draw only one sheet of steel material having a thickness of 9 mm. Likewise, the magnetic pole face areas of the magnetic core members of other electromagnetic elements 12*b*,12*c* and 12*d* are determined so that the electromagnetic element 12*b* is adaptable to the handling of a sheet steel having a thickness of 6 mm, the electromagnetic element 12*c* is adaptable to the one having a thickness of 3 mm, and the electromagnetic element 12*d* is for the one having a thickness of 1 mm, respectively.

In general, since the number of magnetic lines of force penetrating from one magnetic pole to another through a sheet of steel material has a value of magnetic saturation which corresponds to a cross-sectional area of the sheet steel, and since when a magnetic pole face area is too large with respect to a given thickness of a steel sheet, there is obtained a more number of magnetic lines of force than that required to have the cross-sectional area of that steel sheet saturated properly, the magnetic lines of force would reach a second or further sheets adjacent a first sheet of steel piled up in a stack, and therefore, it would become difficult to lift up the only first sheet thereof in the lifting operation. This is the problem that was encountered in the conventional electromagnetic lifting device.

In contrast, according to the present invention, there is provided an improved electromagnetic lifting device which comprises, as stated hereinbefore, a plurality of individual electromagnetic core members having a variety of suitable magnetic pole face areas predetermined in accordance with a thickness or a unit cross-sectional area of a steel sheet to be handled so that the only first sheet of steel material may be positively drawn and lifted upwardly from the pile of steel sheets.

In operation, the electromagnetic lifting device 10 may therefore be operated with the specific electromagnets so selected in accordance with thickness of a steel sheet to be handled in the lifting operation. In this operation, in the construction as typically shown in FIG. 3, the coils 26 and 28 turned around the magnetic core member 24 of one or more selected electromagnets are caused to conduct electric current so as to have that particular electromagnets energized, accordingly. Likewise, the electric power is selectively supplied to the coils 26,27 and 28 in the case of the construction shown in FIG. 5, and to the coil 27 in the case shown in FIG. 6.

There are provided a plurality of on-off switches which may be shifted for the selection of one or more electromagnets to be energized so as to obtain a suitable combination of magnetic pole face areas in accordance with the thickness of a steel sheet to be handled, thus assuring that only one sheet is positively held and lifted up at the moment of attraction. When the step of attraction for a single sheet of steel is successful, all the electromagnetic elements may be put to be energized in order to prevent an occasional falling of the attracted sheet due to deflection, inclination, or swinging motion while held by the lifting device thereof for a safety operation. With this safety procedure, further handling of thus-lifted sheet steel may be assured with ease and safety.

By virtue of the advantageous features as embodied according to the present invention as fully discussed hereinbefore, once that one or more electromagnets are selected priorly, and without any further delicate operation requiring a proficiency, it is now possible to have a desired only one sheet of steel material lifted and released positively and safely, by merely flipping on and off the electric switches so as to cause thus-selected electromagnets to be energized and deenergized as desired. This on-off operation of the electric switches may be remotely controlled and/or automated, thus a remote and/or unmanned operation being made available in practice.

What is claimed is:

1. An electromagnetic lifting device comprising:

a plurality of magnetic core means having a plurality of magnetic pole faces in a common horizontal plane, at least one electric coil adapted to energize each of said magnetic core means, non-ferromagnetic means disposed between said magnetic core means and adapted to rigidly connect adjacent ones of said magnetic core means, non-ferromagnetic suspension means adapted to hold said plurality of magnetic core means in a suspended relationship therefrom;

said magnetic core means having different areas of said magnetic pole faces and being arranged in an array so that each having said different areas of magnetic pole faces is placed adjacent to each other and symmetrically with respect to the center line of said electromagnetic lifting device.

2. The electromagnetic lifting device as claimed in claim 1, wherein said magnetic core means comprise a pair of leg portions extending outwardly in parallel, with a magnetic pole face defined at each free end thereof, and a web portion connecting said pair of leg portions as a unit, thereby to form an inverted generally U-shape.

3. The electromagnetic lifting device as claimed in claim 1, wherein said magnetic core means comprise three leg portions extending outwardly in parallel and with a magnetic pole face defined at each free end thereof and a web portion connecting said three leg portions as a unit, thereby to form an inverted generally W-shape.

4. The electromagnetic lifting device as claimed in claim 3, wherein an area of a magnetic pole face defined in central one of said three leg portions is determined to be equal with the sum of the magentic pole face areas of the remaining two others disposed at both outer sides thereof.

5. The electromagnetic lifting device as claimed in claim 1, wherein each magnetic core means has a pair of leg portions and said electric coil is provided around each of said leg portions.

6. The electromagnetic lifting device as claimed in claim 1, wherein each magnetic core means has three leg portions and said electric coil is provided around each of said leg portion.

7. The electromagnetic lifting device as claimed in claim 1, wherein each magnetic means has three leg portions and said electric coil is provided around a central one of the leg portions.

8. The electromagnetic lifting device as claimed in claim 1, wherein said coil for each of said magnetic core means are collectively connected through one electric switch means to a power source.

9. The electromagnetic lifting device as claimed in claim 1, wherein each of said coils is respectively connected through one electric switch to a power source.

* * * * *